US006412923B1

(12) United States Patent
Takahashi

(10) Patent No.: US 6,412,923 B1
(45) Date of Patent: Jul. 2, 2002

(54) INK EJECTOR THAT EJECTS INK IN ACCORDANCE WITH PRINT INSTRUCTIONS

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/536,389

(22) Filed: Mar. 28, 2000

Related U.S. Application Data

(63) Continuation-in-part of application No. 09/324,140, filed on Jun. 2, 1999, now abandoned.

(30) Foreign Application Priority Data

Jun. 3, 1998 (JP) ..... 10-154580
Jun. 2, 1999 (JP) ..... 11-155092
Jul. 8, 1999 (JP) ..... 11-194518

(51) Int. Cl.[7] ..... B41J 2/045
(52) U.S. Cl. ..... 347/68; 347/10; 347/11
(58) Field of Search ..... 347/68, 71, 19, 347/11, 12, 13, 40

(56) References Cited

U.S. PATENT DOCUMENTS 5,909,228 A * 6/1999 Takahashi ..... 349/11 X
6,030,067 A * 2/2000 Kawamura ..... 347/37
6,141,113 A * 10/2000 Takahashi ..... 358/1.8

FOREIGN PATENT DOCUMENTS

JP 9-104110 4/1997

* cited by examiner

*Primary Examiner*—Benjamin R. Fuller
*Assistant Examiner*—C Dickens
(74) *Attorney, Agent, or Firm*—Oliff & Berridge PLC

(57) ABSTRACT

An ink ejector has ink channels formed therin. The ejector ejects two consecutive ink droplets for each dot. In this case, an ejection pulse is applied to eject the first droplet from the appropriate channel, and then a non-ejection pulse is applied to cancel the pressure wave vibration generated in the channel by the ejection. Thereafter, when the pressure in the channel is stable, another ejection pulse is applied to eject the second droplet, and then another non-ejection pulse is applied to cancel the pressure wave vibration generated in the channel by the second ejection. Thus, after each droplet is ejected, the vibration generated by the ejection is canceled. This can stabilize the ejection of each droplet. Therefore, even if the drive frequency fluctuates slightly, the printing quality can be high.

34 Claims, 9 Drawing Sheets

Fig. 10

| | E/P-A | | E/P-B | | N/E-C | | E/P-D | | E/P-E | | N/E-F |
|---|---|---|---|---|---|---|---|---|---|---|---|
| | Wa | d1 | Wb | d2 | Wc | d3 | Wd | d4 | We | d5 | Wc |
| WAVE FORM 1 | 1.00 | 1.00 | 1.00 | 2.25 | 0.5 | 0.5 | 1.00 | 1.00 | 1.00 | 2.25 | 0.5 |
| WAVE FORM 2 | 1.00 | 1.00 | 1.00 | 2.15 | 0.5 | 1.5 | 0.50 | 1.00 | 1.00 | 2.15 | 0.5 |
| WAVE FORM 3 | 0.30 ~ 1.30 | 0.70 ~ 1.30 | 0.30 ~ 1.30 | 2.05 ~ 2.45 | 0.30 ~ 0.70 or 1.30 ~ 1.80 | 0.30 ~ 2.00 | 0.30 ~ 1.30 | 0.70 ~ 1.30 | 0.30 ~ 1.30 | 2.05 ~ 2.45 | 0.30 ~ 0.70 or 1.30 ~ 1.80 |

E/P: EJECTION PULSE

N/E: NON-EJECTION PULSE

Wa, Wb, Wc, Wd, We: WIDTH d1, d2, d3, d4, d5: INTERVAL

INK EJECTOR THAT EJECTS INK IN ACCORDANCE WITH PRINT INSTRUCTIONS

CROSS REFERENCE

This application is a Continuation-in-Part Application claiming a benefit of U.S. patent application Ser. No. 09/324,140 filed on Jun. 2, 1999 now abandoned based on Japanese Patent Application No. 10-154580, and claiming priority of Japanese Patent Application Nos. 11-155092 and 11-194518.

BACKGROUND OF THE INVENTION

1. Field of the Invention

The present invention relates to an ink ejector for forming an image on a recording medium such as paper by ejecting ink in accordance with print instructions.

2. Description of Related Art

Ink jet printers have a simpler principle than any other non-impact printers, and are easy of multiple gradation and colorization. Drop-on-demand ink jet printers eject only droplets of ink for printing. Ink jet printers of this type are coming rapidly into wide use because of high ejection efficiency and low running costs.

For example, U.S. Pat. No. 4,879,568, U.S. Pat. No. 4,887,100, U.S. Pat. No. 4,992,808, U.S. Pat. No. 5,003,679 and U.S. Pat. No. 5,028,936, which correspond to Japanese Patent Application Laid-Open No. 63-247051, disclose ink ejectors of the shear mode type as drop-on-demand inkjet printers. Each of the ejectors includes a controller and an ink jet head. The head has actuator walls of piezo-electric material, which are arranged in pairs to define channels between them. The head also has nozzles for the respective channels.

A conventional ink ejector of this type ejects a series of ink droplets in accordance with the print instruction for one dot. The ejector ejects each of the droplets by generating a pressure wave vibration in the appropriate ink channel. After ejecting the serial droplets, the ejector substantially cancels the pressure wave vibration in the channel by once increasing the volume of the channel and then decreasing it. In other words, the ejector carries out a cycle of ejection of serial ink droplets and cancellation of vibration in accordance with the print instruction for one dot. The number of such cycles per second is the drive frequency of the ejector.

This ejector can form a thick image on paper or another recording medium, and prevents the residual pressure wave vibration in the channel from producing ill or adverse effects on the next ejection.

After the droplets are ejected, the pressure wave vibration in the channel is very complicated. It is therefore very difficult to completely cancel this vibration. For this reason, the cancellation of vibration after ejection of serial ink droplets requires very accurate timing.

The ink jet head of this ejector is mounted on a carriage, which can be driven by a motor. While the carriage is moving along a recording medium, a print instruction signal is generated for each dot on the basis of the associated positional signal from an encoder. The resistance to the carriage movement may not be uniform, and the rotational speed of the carriage motor may fluctuate. There may be a case where the drive frequency fluctuates by about ±5%. In this case, as compared with a case where the drive frequency is constant, the cancellation of vibration for a dot may not occur at the predetermined time with respect to the pressure fluctuation caused for the preceding dot in the appropriate channel. As a result, the cancellation may not be effective, and the droplets may differ in volume by about ±15%. This may worsen the printing quality. In particular, this may make the quality very poor in a case where ink is ejected at a uniform gradation in a wide area. In order to keep the drive frequency constant, the fluctuation of the moving speed of the carriage could be restrained. This would require an expensive motor, an expensive driving system and a precisely machined or wrought carriage guide, resulting in greatly increased part costs.

SUMMARY OF THE INVENTION

It is an object of the invention to provide an ink ejector for ejecting a series of ink droplets to print one dot, and for always good printing quality without need for high part costs. It is another object of the invention to provide an ink jet printer having a ink jet head for ejecting a series of ink droplets to print one dot, which can keep good printing quality without need for high part costs.

In accordance with a first aspect of the invention, an ink ejector is provided, which includes an ink jet head for ejecting ink. The head has an ink channel formed therein, which can be filled with ink. The head also has an ink nozzle formed therein and communicating with the channel. The head includes an actuator provided therein for changing the volume of the channel. The ejector also includes a controller for controlling the actuator to change the volume of the channel to carry out ejection of an ink droplet from the channel through the nozzle a plurality of times in accordance with a print instruction for one dot. The controller controls the actuator to carry out substantial cancellation of pressure wave vibration in the channel after each ejection is carried out.

Thus, after ejecting each ink droplet, the ejector substantially cancels the pressure wave vibration to stabilize the pressure in the ink channel. This greatly simplifies the vibration which should be substantially canceled after each droplet is ejected. Therefore, even if the ejection and the substantial cancellation deviate slightly from the optimum points of time, it is possible to substantially cancel the vibration without difficulty. Consequently, even if the drive frequency fluctuates slightly, it is possible to eject a substantially constant amount of ink at each of the times. It is accordingly possible to maintain good printing quality without raising part costs by using an expensive motor etc.

The substantial cancellation may involve increasing the volume of the ink channel and decreasing the increased volume after a time WS. The inventor made experiments with the time WS varied, and a study of conditions for most effectively canceling the pressure wave vibration in the channel. The experiment and study revealed that the time WS should be set between 0.3T and 0.7T or between 1.3T and 1.8T where T is the one-way propagation time when a pressure wave of ink propagates one way in the channel. The reason for this is presumed as follows.

If the time WS is approximately 1.0 T (WS≈1.0 T), the peak of the pressure wave vibration generated by the increase in volume of the ink channel and the rise in pressure due to the decrease in volume of the channel (at point SE1) are superimposed on each other, ejecting ink from the channel. If the time WS is approximately 2.0T (WS ≈2.0T), the pressure wave vibration due to the increase in volume and the pressure wave vibration due to the decrease in volume cancel each other. The result of this case is similar to that of a case where no cancellation is carried out. It is therefore conceivable that good substantial cancellation of pressure wave vibration can be carried out with the time WS set between 0.3T and 0.7T which are intermediate between 0 and 1.0T or between 1.3T and 1.8T, which are intermediate between 1.0T and 2.0T.

The ejection and the substantial cancellation may involve applying an ejection voltage pulse of predetermined timing and width and a cancellation voltage pulse of predetermined timing and width, respectively, to the actuator. The ejection voltage pulse may have a width which is an odd number of times as long as T. The cancellation voltage pulse may have a width between 0.3T and 0.7T or between 1.3T and 1.8T. The time between the trailing edge of the ejection voltage pulse and the middle point of the cancellation voltage pulse may range between 2.35T and 2.65T, and preferably be about 2.5T.

The substantial cancellation may involve increasing the volume of the ink channel once when the pressure in the channel is high, and restoring the increased volume. Otherwise, this cancellation may involve decreasing the channel volume once when the pressure in the channel is low, and restoring the decreased volume. If the ejection involves increasing the channel volume once and restoring the increased volume, it is preferable that the substantial cancellation likewise involve increasing the volume once and restoring the increased volume. In this case, because the actuator is driven in the same directions for the ejection and the substantial cancellation, it is possible to simplify the drive means etc. in structure.

The ink ejector may also include a carriage for carrying the ink jet head thereon by moving along a surface of a recording medium. The ejector may further include a detector for detecting the position of the carriage. On the basis of the detected carriage position, the controller controls the actuator. The detector may include an encoder extending in the directions in which the carriage can move. The detector may also include a sensor fitted on the carriage. The sensor can read the indexes of the encoder.

In accordance with a second aspect of the invention, an ink jet printer is provided, which includes an ink jet head for ejecting ink. The head has an ink channel formed therein, which can be filled with ink. The head also has an ink nozzle formed therein and communicating with the channel. The head includes an actuator provided therein for changing the volume of the channel. The head is mounted on a carriage for moving along a surface of a recording medium. The position of the carriage can be detected by a detector. On the basis of the detected carriage position, a controller controls the actuator to change the volume of the channel to carry out ejection of an ink droplet from the channel through the nozzle a plurality of times in accordance with a print instruction for one dot. The controller controls the actuator to carry out substantial cancellation of pressure wave vibration in the channel after each ejection is carried out.

Thus, the actuator of this printer is controlled on the basis of the detected position of the ink jet head. Specifically, on the basis of the detected position of the head or the carriage, the ejection of ink from the head for each dot is timed. This ensures proper ejection timing even if the rotational speed of the motor driving the carriage, on which the head is mounted, fluctuates, or even if a drive mechanism such as the pulleys and the belt which transmit the driving force of the motor to the carriage slips. In the meantime, the actuator drive frequency fluctuates as stated above. Specifically, the ejection for dots does not start at a constant frequency. Accordingly, for example, when ink is ejected for a certain dot after ink is ejected for the preceding dot, the substantial cancellation for the certain dot is carried out at a point different from the predetermined point with respect to the pressure wave generated by the ejection and the substantial cancellation for the preceding dot.

The printer according to the invention carries out the substantial cancellation after the ejection of each droplet. Therefore, the cancellation timing is simple. This reduces the bad influence of the fluctuation in the amount of ejected ink, the fluctuation occurring if the actuator drive frequency fluctuates. Consequently, even if the frequency fluctuates, the amount of ejected ink per dot can be kept substantially constant. Therefore, this printer can eject ink at equal gradation for good printing quality, and needs no expensive motor and/or no accurate or precise carriage guide for keeping the drive frequency constant.

In accordance with a third aspect of the invention, another ink ejector is provided. This ejector includes an ink jet head for ejecting ink. The head has an ink channel and an ink nozzle formed therein. The channel communicates with the nozzle and can be filled with ink. The head includes an actuator provided therein for changing the volume of the channel. The ejector also includes a controller for controlling the actuator to change the volume of the channel to carry out an ejection operation which ejects an ink droplet from the channel through the nozzle "N" times in accordance with a print instruction for one dot. The number "N" is an integer which is equal to or more than two ($2 \leqq N$). The controller so controls the actuator as to carry out at least twice a combination of "n" ejection operations, each of which ejects an ink droplet from the channel through the nozzle and a cancellation operation which substantially cancels pressure wave vibration in the channel subsequent to the ejection. The number "n" is an integer which is equal to or more than one, but smaller than the number "N" ($1 \leqq n \leqq N$).

Every time this ink ejector has performed at least one ejection operation for ejecting an ink droplet from the channel, it substantially cancels the pressure wave vibration in the channel to stabilize the pressure in the channel. This relatively simplifies the pressure wave vibration which should be canceled each time by the cancellation operation. Therefore, even if the ejection operations and the cancellation operation deviate slightly from the optimum points of time, it is possible to substantially cancel the pressure wave vibration without difficulty.

The ink ejector may carry out, at least twice, the combination of two or three ejection operations and the cancellation operation subsequent to the ejection operations. Otherwise, the ejector may carry out, at least twice, the combination of one ejection operation and the cancellation operation subsequent to the one ejection operation. If the ejector carries out the cancellation operation every time it has performed two or more ejection operation, it is possible to shorten the time taken to eject ink a number of times for one dot. This results in high speed recording.

In accordance with a fourth aspect of the invention, another ink jet printer is provided. This printer includes an ink jet head for ejecting ink. The head has an ink channel and an ink nozzle formed therein. The channel communicates with the nozzle and can be filled with ink. The head includes an actuator provided therein for changing the volume of the channel. The head is supported by a carriage which can move along a surface of a recording medium. The printer also includes a detector for detecting the position of the carriage. The printer further includes a controller for so controlling the actuator on the basis of the detected carriage position to change the volume of the channel to carry out ejection of an ink droplet from the channel through the nozzle "N" times in accordance with a print instruction fo[00f8] on[0085] dot. The number "N" is an integer which is equal to or more than two ($2 \leqq N$). The controller so controls the actuator as to carry out at least twice a combination of "n" ejection operations, each of which ejects an ink droplet from the channel through the nozzle and a cancellation operation which substantially cancels pressure wave vibration in the channel subsequent to the ejection. The number "n" is an integer which is equal to or more than one, but smaller than the number "N" ($1 \leqq n < N$).

In this ink jet printer, as stated above, the pattern of ejection operations and cancellation operation is adjusted. This makes it possible to effectively cancel the pressure wave vibration, even if the rotational speed of the motor for driving the carriage fluctuates, or a drive mechanism such as the pulleys or the belt for transmitting the driving force of the motor to the carriage slips, causing the actuator drive frequency to fluctuate. Therefore, this printer can eject ink at equal gradation for good printing quality, and needs no expensive motor and/or no accurate carriage guide for keeping the drive frequency constant.

BRIEF DESCRIPTION OF THE DRAWINGS

A preferred embodiment of the invention is described with reference to the accompanying drawings, in which:

FIG. 10 is a table showing various values for the drive waveform shown in FIG. 9.

DETAILED DESCRIPTION OF A PREFERRED EMBODIMENT

First Embodiment

Figure 5A:
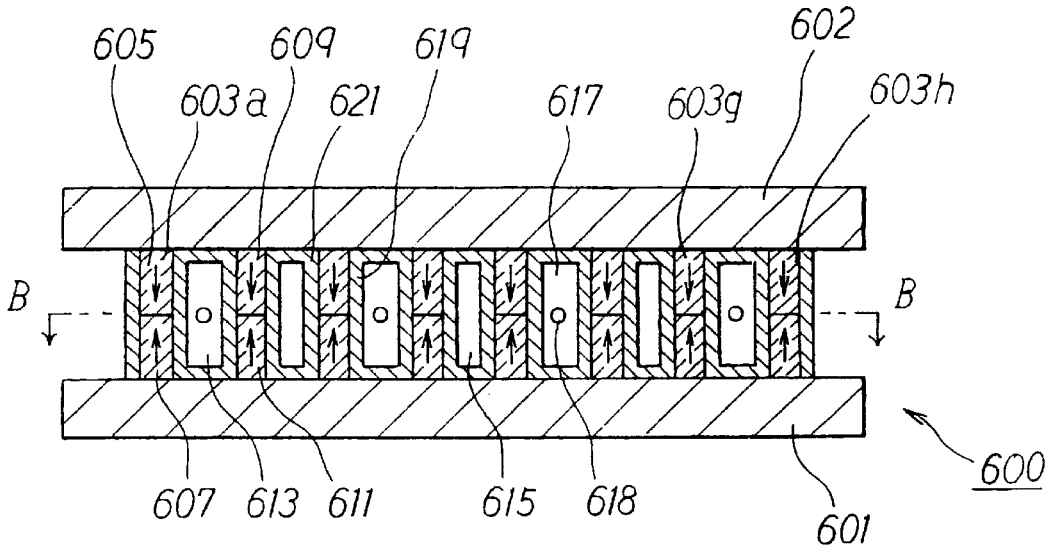
FIG. 5A is a cross section of the ejector, which is taken on the line A—A of FIG. 5B.
Figure 5B:
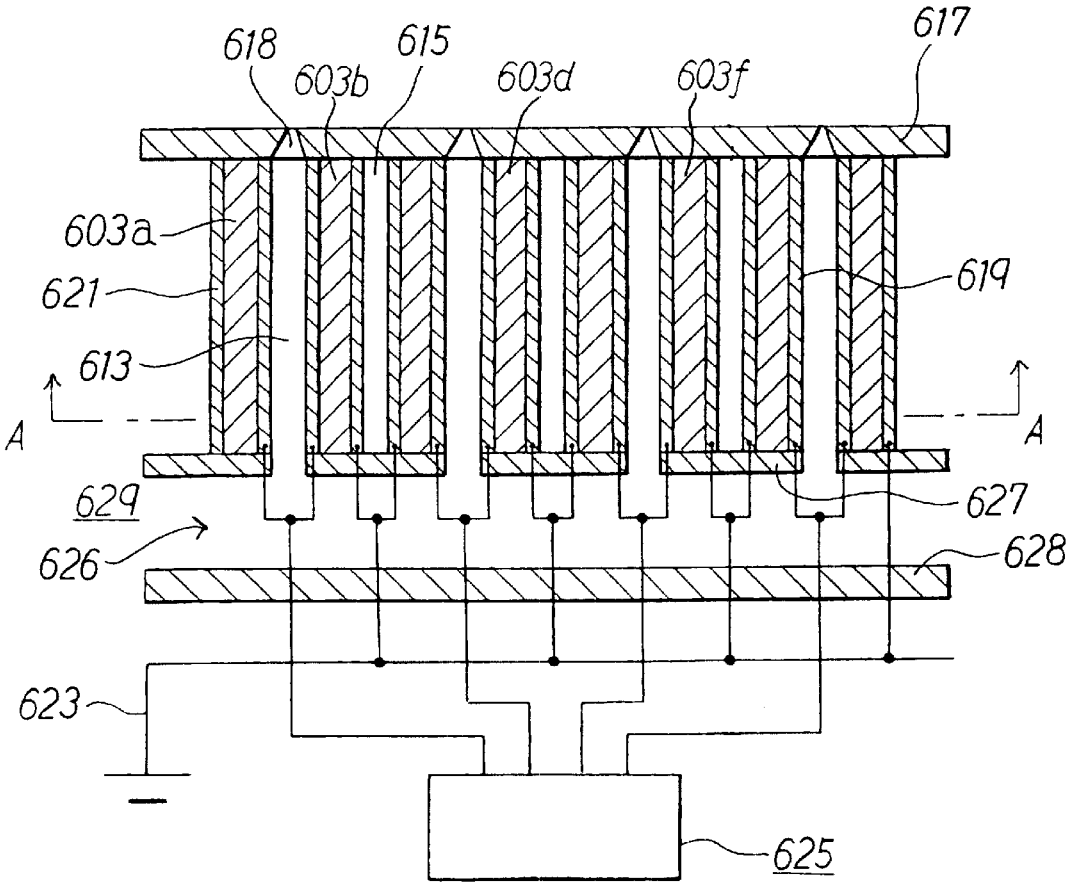
FIG. 5B is a cross section taken on the line B—B of FIG. 5A.
Figure 7:
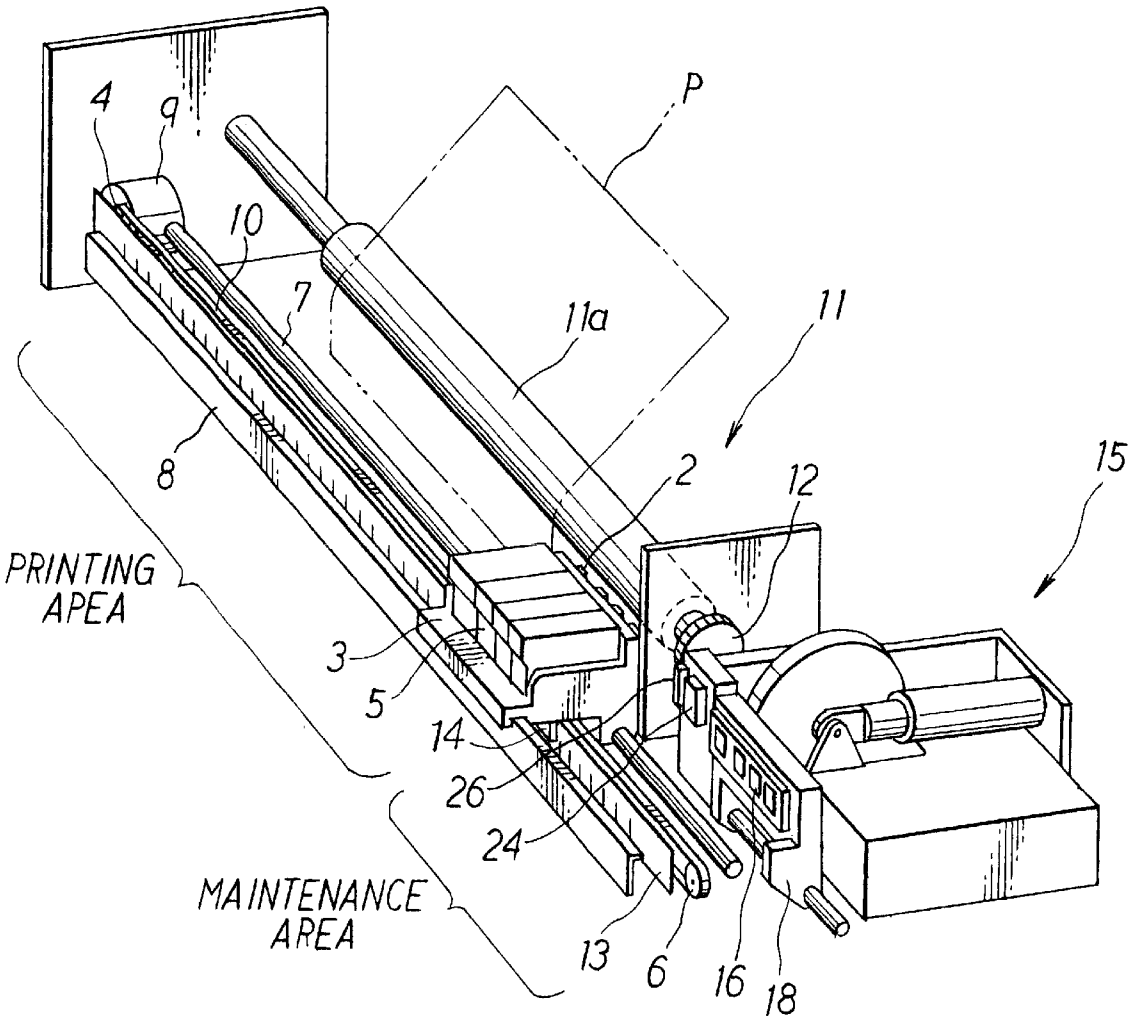
FIG. 7 is a perspective view of the internal structure of an ink jet printer to which the ejector is applied.

With reference to FIGS. 5A and 5B, an ink ejector 600 embodying the invention is mounted on a carriage (see reference numeral 3 in FIG. 7) for moving along a guide bar (not shown see reference numerals 7 and 8 in FIG. 7).

The ejector 600 includes a base wall 601 and a top wall 602, between which eight shear mode actuator walls 603*a*–603*h* extend. The actuator walls 603*a*–603*h* each consist of an upper part 605 and a lower part 607, which are made of piezo-electric material. The wall parts 605 and 607 are bonded to the top wall 602 and the base wall 601, respectively, and polarized in the opposite directions of arrows 609 and 611, respectively. The actuator walls 603*a*, 603*c*, 603*e* and 603*g* pair with the actuator walls 603*b*, 603*d*, 603*f* and 603*h*, respectively, to define a channel 613 between each pair of actuator walls. The actuator walls 603*b*, 603*d* and 603*f* pair with the actuator walls 603*c*, 603*e* and 603*g*, respectively, to define a space 615 between each pair of actuator walls. The three spaces 615 are narrower than the four channels 613.

At one end of the channels 613 is secured a nozzle plate 617 formed with nozzles 618 each communicating with one of the channels. The other ends of the channels 613 are connected through a manifold 626 to an ink supply (not shown). The manifold 626 includes a front wall 627 and a rear wall 628. These walls 627 and 628, part of the top wall 602 and part of the base wall 601 define a chamber 629. The front wall 627 is formed with holes each communicating with one of the channels 613. Ink can be supplied from the supply to the chamber 629, and then be distributed to the channels 613.

The longer four sides of each channel 613 are lined with an electrode 619. The longer four sides of each space 615 are lined with an electrode 621. The outer sides of the actuator walls 603*a* and 603*h* at both ends are each lined with an electrode 621. The electrodes 619 and 621 take the form of metallized layers. The electrode 619 in each channel 613 is passivated with an insulating layer (not shown) for insulation from ink. The electrodes 619 in the channels 613 are connected to a controller 625 for applying voltage from an electric source (not shown) to these electrodes. The controller 625 is provided in or on the ejector 600. The other electrodes 621 are connected to a common ground return 623.

Figure 6:
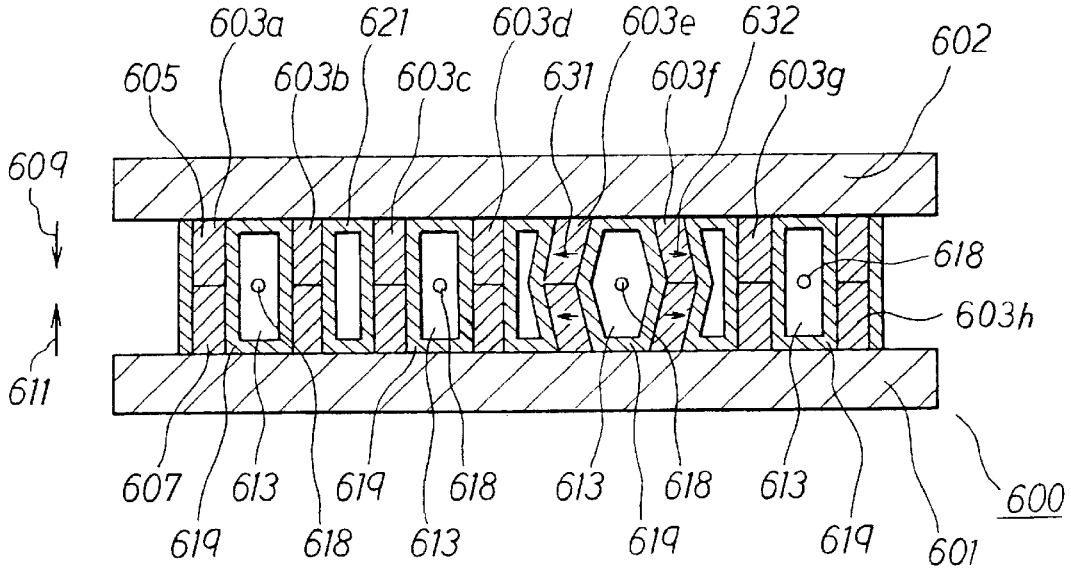
FIG. 6 is a cross section similar to FIG. 5A, but showing the operation of the ejector.

In operation, the voltage applied to the electrode 619 in each channel 613 causes the associated actuator walls to deform or deflect piezo-electrically in such directions that the channel enlarges in volume. If, as shown in FIG. 6, a voltage of E volts is applied to the electrode 619 between the actuator walls 603*e* and 603*f*, for instance, electric fields are generated in these walls in the opposite directions of arrows 631 and 632. This deforms the walls 603*e* and 603*f* piezo-electrically in such directions that the associated channel 613 enlarges, reducing the pressure in this channel to a negative pressure.

The voltage applied to the electrode 619 is held for a period L/V where L is the channel length and V is the sound velocity (the velocity of the acoustic pressure wave) in the ink in the channel 613. While the voltage is applied, ink is supplied to the channel 613. The period L/V is the one-way propagation time T when a pressure wave in the channel 613 propagates one way longitudinally of the channel.

According to the theory of pressure wave propagation, the negative pressure in the channel 613 reverses into a positive pressure when the period L/V passes after the voltage is applied to the electrode 619. When the pressure becomes positive, the controller 625 returns the voltage to zero volt. This allows the deformed actuator walls 603*e* and 603*f* to return to their original condition (FIGS. 5A and 5B), generating a positive pressure in the channel 613. This pressure is added to the pressure which has reversed to be positive reversed to be positive. As a result, a relatively high pressure develops in that portion of the channel 613 which is near to the associated nozzle 618, ejecting ink out through the nozzle.

Each channel 613 has a length L of 7.5 millimeters. Each nozzle 618 has a length of 100 microns (micrometers), a diameter of 40 microns at its front end and a diameter of 72 microns at its rear end. The space between the outer side of the nozzle plate 617 and the recording paper on the platen is 1–2 millimeters.

The ink used in the experiments mentioned later had a viscosity of about 2 mPa·s and a surface tension of 30 mN/m at a temperature of 25 degrees C. The period L/V (=T) in relation to this ink was 8 microseconds.

Figure 1:
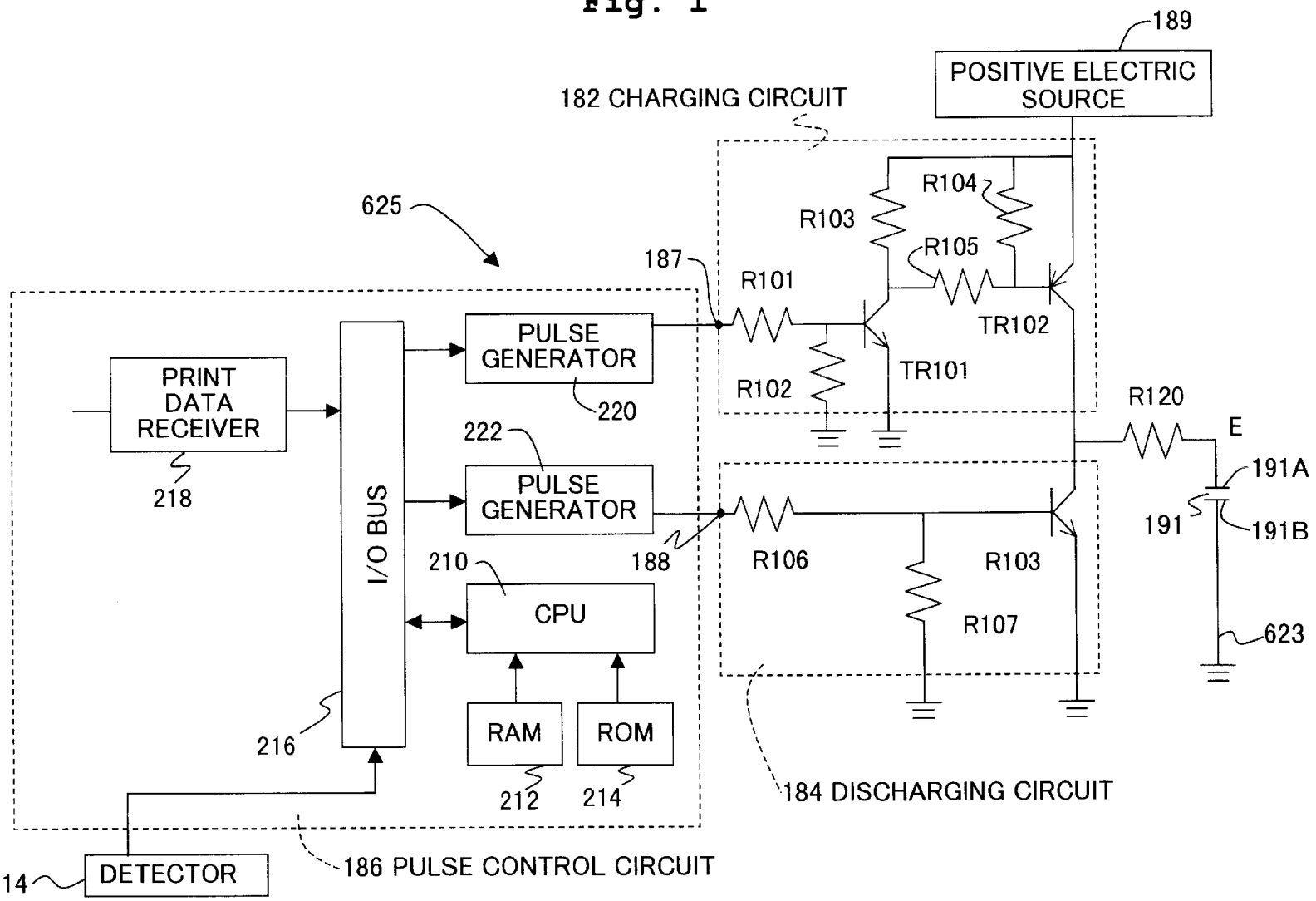
FIG. 1 is a block/circuit diagram of the controller of an ink ejector embodying the invention.

With reference to FIG. 1, the controller 625 includes a pulse control circuit 186, four charging circuits 182 (only one shown) and four discharging circuits 184 (only one shown). Four capacitors 191 (only one shown) represent the piezo-electric materials of the actuator walls 603*a*–603*h* and the electrodes 619 and 621. The capacitors 191 have terminals 191A and 191B, which correspond to the electrodes 619 and 621, respectively. The terminals 191A and 191B are connected to the controller 625 and the ground return 623, respectively.

Each charging circuit 182 has an input terminal 187, through which this circuit can receive from the pulse control circuit 186 a pulse signal for application of a voltage of E volts to one of the capacitor terminals 191A (electrodes 619 in the channels 613). This voltage may be 20 volts. Each discharging circuit 184 has an input terminal 188, through which this circuit can receive from the control circuit 186 a pulse signal for application of no voltage (0 volt) to one of the terminals 191A.

Each charging circuit 182 includes transistors TR101 and TR102. The base of the transistor TR101 is connected to the associated input terminal 187 through a resistor R101 and grounded through a resistor R102. The emitter of the transistor TR101 is grounded directly, and the collector of this transistor is connected to a common positive electric source 189 of E volts through a resistor R103. The base of the transistor TR102 is connected to the source 189 through a resistor R104, and to the collector of the transistor TR101 through a resistor R105. The emitter of the transistor TR102 is connected directly to the source 189, and the collector of this transistor is connected to the associated capacitor terminal 191A through a resistor R120.

If a pulse (+5 volts) is input to the input terminal 187, the transistor TR101 becomes conductive, allowing current from the positive electric source 189 to flow from the collector of this transistor to the emitter of the transistor. This raises the voltages applied to the resistor R105 and the resistor R104, which is connected to the source 189.

Consequently, the current flowing into the base of the transistor TR102 increases, making this transistor conductive between its emitter and collector. As a result, the voltage of E volts is applied from the source 189 through the emitter and the collector of the transistor TR102, and through the resistor R120, to the capacitor terminal 191A.

Each discharging circuit 184 includes a transistor TR103, the base of which is connected to the associated input terminal 188 through a resistor R106 and grounded through a resistor R107. The emitter of the transistor TR103 is grounded directly, and the collector of this transistor is connected to the associated capacitor terminal 191A through the resistor R120 associated with this terminal.

If a pulse (+5 volts) is input to the input terminal 188, the transistor TR103 becomes conductive, grounding the capacitor terminal 191A through the resistor R120.

Explanation will be made of the variation in the voltage applied to each capacitor 191 (actuator walls) by the associated charging and discharging circuits 182 and 184.

Figure 2:
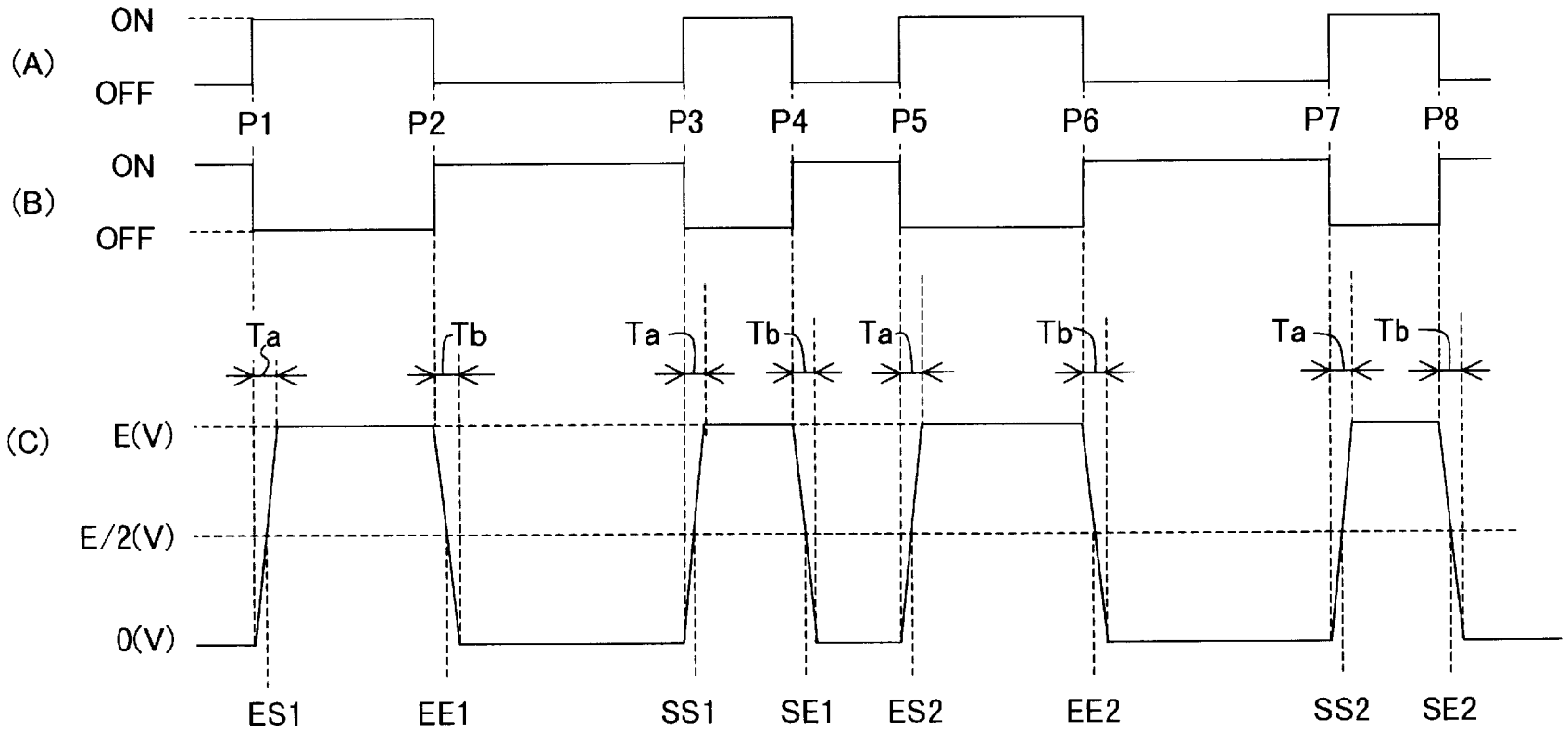
FIG. 2 is a timing chart showing the operations of the charging and discharging circuits of the controller.

As shown at (A) in FIG. 2, the signal input to the input terminal 187 of the charging circuit 182 is normally off. For ejection of ink droplets, the input signal is rendered on at a point of time P1, off at a point of time P2, on at a point of time P3, off at a point of time P4, on at a point of time P5, off at a point of time P6, on at a point of time P7 and off at a point of time P8. As shown at (B) in FIG. 2, the signal input to the input terminal 188 of the discharging circuit 184 becomes off at the points P1, P3, P5 and P7, and on at the points P2, P4, P6 and P8.

In this case, as shown at (C) in FIG. 2, the voltage applied to the terminal 191A of the capacitor 191 is normally held at 0 volt. This voltage becomes E volts when a charging time Ta passes after the capacitor 191 starts charging at the point P1. The time Ta depends on the transistor TR102, the resistor R120 and the electric capacity of the actuator walls, which are shear mode type piezo-electric elements, corresponding to the capacitor 191. The voltage becomes 0 volt again when a discharging time Tb passes after the capacitor 191 starts discharging at the point P2. The time Tb depends on the transistor TR103, the resistor R120 and the actuator wall capacity.

In this way, the drive waveform of voltage applied actually to the capacitor terminal 191A (electrode 619) is delayed by the time Ta and the time Tb when it rises and falls, respectively. Therefore, the points of time on the waveform when the voltage is E/2 volts, which may be 10V, are defined as approximate rising points ES1, SS1, ES2 and SS2 and approximate falling points EE1, SE1, EE2 and SE2 of the voltage. In order to time these rising and falling points suitably as stated later, the pulse control circuit 186 controls at least the points of time P1–P8 of the signals input to the input terminals 187 and 188.

Back to FIG. 1, the pulse control circuit 186 includes a CPU 210 for various operations, which is connected to a RAM 212 and a ROM 214. The RAM 212 stores print data and other data in it. The ROM 214 stores in it the control program for the control circuit 186 and the sequence data for generation of pulses at the points of time P1–P8.

Figure 3:
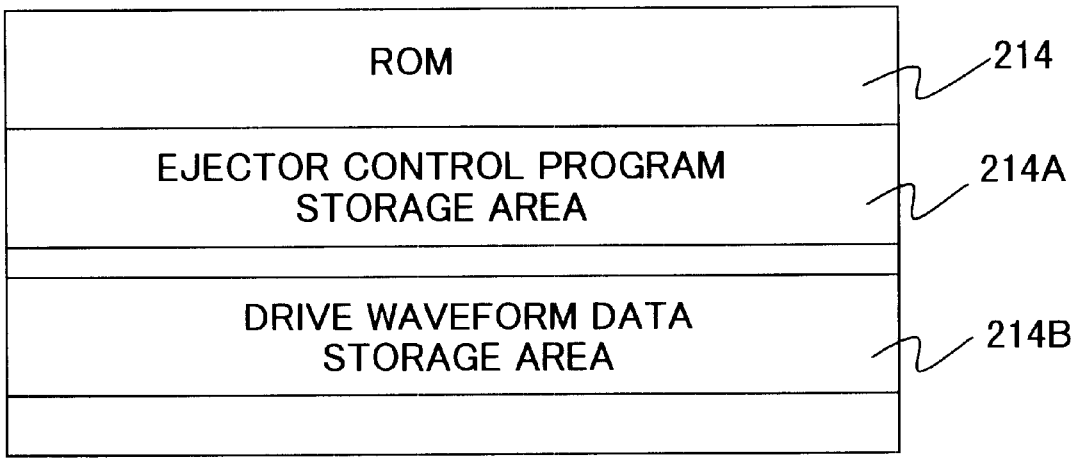
FIG. 3 is n illustration showing the structure of the ROM of the controller.

As shown in FIG. 3, the ROM 214 includes an ejector control program storage area 214A and a drive waveform data storage area 214B. The sequence data relating to the drive waveform are stored in the area 214B.

The CPU 210 is connected to an I/O bus 216 via which various data can be input and output. The I/O bus 216 is connected to a print data (print instruction) receiver 218, four first pulse generators 220 (only one shown) and four second pulse generators 222 (only one shown). The output terminal of each first pulse generator 220 is connected to the input terminal 187 of one of the charging circuits 182. The output terminal of each second pulse generator 222 is connected to the input terminal 188 of one of the discharging circuits 184. The I/O bus 216 is also connected to an optical detector 14 for detecting a position of an ink jet head (print head), which will be described later.

In accordance with the sequence data stored in the area 214B of the ROM 214, the CPU 210 controls the pulse generators 220 and 222. Various patterns of the points P1–P8 are stored in advance in this area 214B. Therefore, in accordance with the print instruction for one dot, it is possible to apply a desired drive waveform of voltage to the appropriate actuator walls. The CPU 210 causes the waveform to be applied to the actuator walls to eject ink from the associated ink channel 613.

Figure 4:
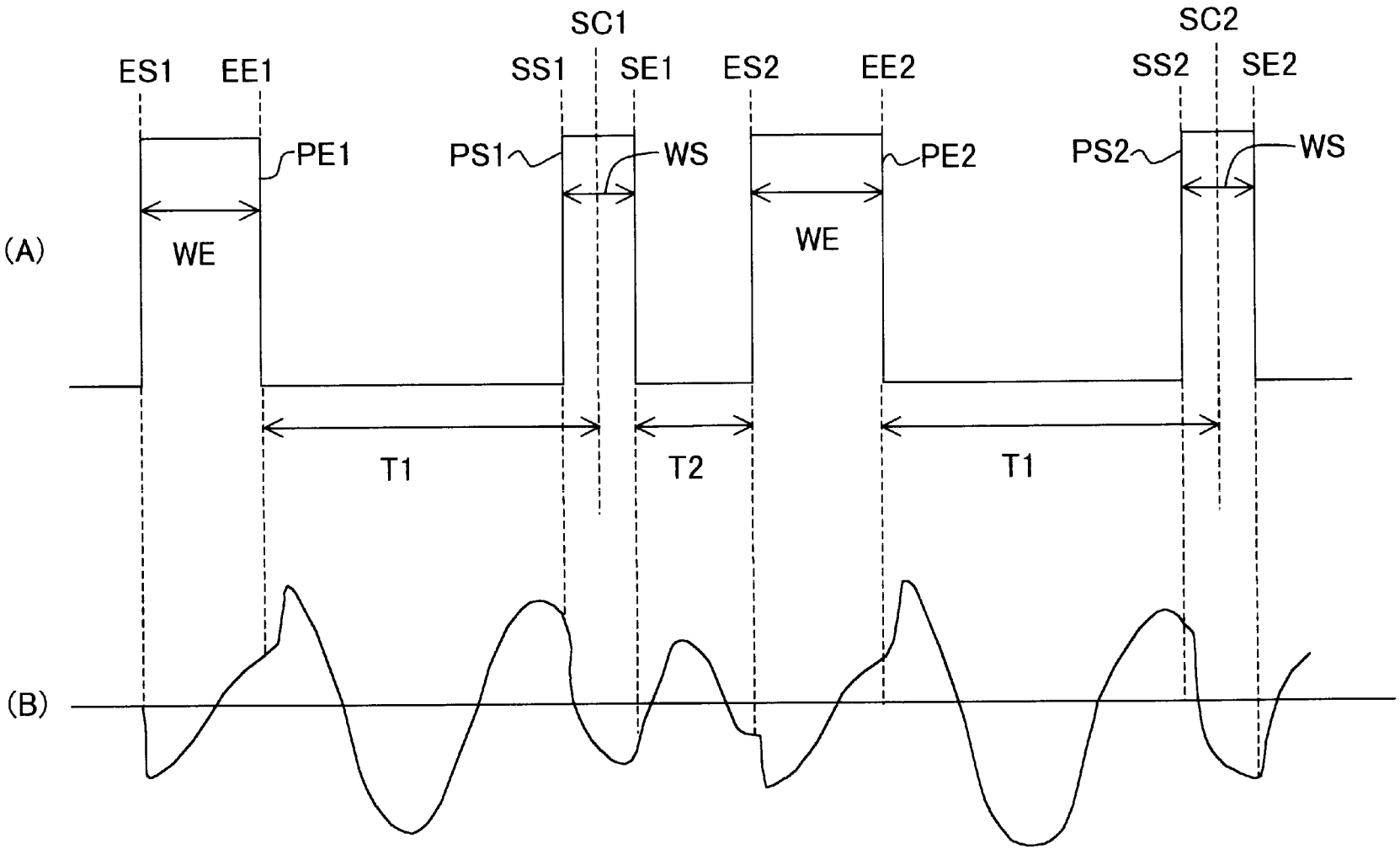
FIG. 4 is an illustration showing a drive waveform output from the controller and the pressure wave vibration of ink generated in response to the waveform.

(A) in FIG. 4 shows an approximate drive waveform of voltage for application to the actuator walls 603*a*–603*h*. (B) in FIG. 4 shows the pressure wave vibration generated in response to this waveform in the channels 613. As shown at (A) in FIG. 4, the waveform includes two ejection pulses PE1 and PE2 for ejection of ink from each channel 613. The pulses PE1 and PE2 are followed by two non-ejection pulses PS1 and PS2, respectively, for cancellation of the pressure wave vibration remaining in the channel 613. The voltage of all the pulses PE1, PE2, PS1 and PS2 is E volts.

As explained later, the width WE of each of the ejection pulses PE1 and PE2 is 1.0T, where T is the one-way propagation time (8 microseconds), and the width WS of each of the non-ejection pulses PS1 and PS2 is 0.5T. As also explained later, the interval T2 between the non-ejection pulse PS1 and the ejection pulse PE2 is 1.0T.

When the ejection pulse PE1 rises at a point of time ES1, electric fields are generated in the appropriate actuator walls (603*e* and 603*f* in FIG. 6). The fields enlarge the volume of the associated channel 613, reducing the pressure in the channel, which includes the vicinity of the associated nozzle 618. Then, ink flows into the channel 613. In the meantime, the volume enlargement generates a pressure wave vibration, which develops a pressure. This pressure rises and reverses the pressure in the channel 613 into a positive pressure (higher than the centerline of vibration). The positive pressure reaches a peak near the point when the one-way propagation time T passes after the point ES1.

The ejection pulse PE1 falls at a point of time EE1. The time between the rising point ES1 and the falling point EE1 is 1.0T. The pulse fall reduces the volume of the channel 613, generating a pressure, which is added to the positive pressure. The addition generates a high pressure in that portion of the channel 613 which is near to the nozzle 618. This pressure ejects an ink droplet from the channel 613 through the nozzle 618.

T1 is the time between the falling point EE1 of the ejection pulse PE1 and the middle point SC1 of the non-ejection pulse PS1. It is preferable that the non-ejection pulse PS1 be generated for a time including a point when the pressure in the channel 613 reverses from a positive to a negative. In this case, it is possible to cancel the pressure wave vibration in the channel 613 in the following manner.

The non-ejection pulse PS1 rises at a point of time SS1 before the pressure in the channel 613 reverses from a positive to a negative. This lowers the still positive pressure quickly. This pulse PS1 falls at a point SE1 after the positive pressure becomes negative. This raises the negative pressure quickly, thereby canceling the pressure wave vibration. The vibration cancellation prevents accidental drops or accidental ejection of ink, and makes it possible to transfer smoothly to the ejection in accordance with the ejection pulse PE2. It is therefore possible to form a very good image on a recording medium and improve the printing speed. The non-ejection pulse PS1 causes no ejection of ink.

The second ejection pulse PE2 rises at a point of time ES2 and falls at a point of time EE2. Likewise, this ejects another ink droplet from the channel 613. The time between the rising point ES2 and the falling point EE2 is 1.0T.

The second non-ejection pulse PS2 rises at a point of time SS2 and falls at a point of time SE2. Likewise, this cancels the pressure wave vibration in the channel 613. T1 is also the time between the falling point EE2 of the ejection pulse PE2 and the middle point SC2 of the non-ejection pulse PS2.

According to an experiment of the inventor, the pressure wave vibration in the channel 613 which is shown in FIG. 4B does not appear in exact form as ink menisci from the nozzle 618, but the menisci protrude and retract in a slower cycle than the pressure wave vibration, and vibrate complexly in combination with the pressure wave vibration etc. This is conceived to be affected by at least the surface tension of the ink in the nozzle 618.

The inventor studied how long the time T1 should be to restrain accidental drops of ink effectively. The inventor's study revealed that the middle point SC1 of the non-ejection pulse PS1 should preferably be the point when the pressure wave vibration crosses its centerline (the axis of abscissas in FIG. 4 (B)) for the third time after the ejection in accordance with the ejection pulse PE1. This prevents accidental drops of ink very well, and makes it possible to transfer very smoothly to the next ejection in accordance with the ejection pulse PE2. The vibration cancellation is of very stable effect under any conditions. It is likewise preferable that the middle point SC2 of the non-ejection pulse PS2 be the point when the vibration crosses its centerline for the third time after the ejection in accordance with the ejection pulse PE1. This makes it possible to transfer smoothly to the ejection in accordance with the ejection pulse PE1 for the next dot.

The inventor measured the point when the pressure wave vibration in the channel 613 crosses its centerline for the third time after the ejection in accordance with the ejection pulse PE1. Based on the measured point, the time T1 was calculated, with the result that T1 was 2.51T. In this embodiment, by setting this value as the time T1, it was possible to cancel the pressure wave vibration well as stated above.

The inventor made ejection experiments with the ejector 600, with the time T1 and the width WS of the non-ejection pulse PS1 varied, and he found out a tolerance or allowable error range for the time T1 and suitable values of the width WS. The experiments revealed that, by so setting the time T1 that the deviation ΔT1 from the measured value (2.51T) of the time T1 falls within a range between about 0.15T and about −0.15T (ΔT1=T1±about 0.15T), and by setting the width WS between 0.3T and 0.7T or between 1.3T and 1.8T, it was possible to eject ink droplets well without injecting them onto wrong spots on a recording medium and/or splashing or spraying ink about. In a case where the time T1 or the width WS deviated even slightly from the associated suitable range, the flying speed of the ejected droplets deviated from a suitable range. This caused ejection of ink droplets onto wrong spots on a recording medium. In a case where the time T1 or the width WS deviated further, the ejected ink was splashed, and the splashed ink stuck to the outer side of the nozzle plate 617, preventing ejection of ink.

The experiments revealed that errors of about ±0.15 were allowable for the time T1. The experiments also revealed that the pulse width WS should be set preferably between 0.3T and 0.7T or between 1.3T and 1.8T, presumably for the following reason.

If the width WS of the non-ejection pulse PS1 were approximately 1.0T (WS≈1.0T), the peak of the pressure wave vibration generated by the increase in volume of the channel 613 (at point SS1 in FIG. 4) and the rise in pressure due to the decrease in volume of the channel (at point SE1) would be superimposed on each other, ejecting ink from the channel. If the width WS were approximately 2.0T (WS≈2.0T), the pressure wave vibration due to the increase in volume and the pressure wave vibration due to the decrease in volume would cancel each other. The result of this case would be similar to that of a case where the non-ejection pulse PS1 is not generated. It is therefore conceivable that good cancellation of vibration can be made with the width WS set between 0.3T and 0.7T or between 1.3T and 1.8T.

In this embodiment, by setting the time T1 at 2.51T and the width WE of the ejection pulse PE1 at 1.0T, it was possible to cancel the pressure wave vibration in the channel 613 very well with the non-ejection pulse PS1. The cancellation was very stably effective. Therefore, without ejecting ink droplets onto wrong spots and/or splashing ink, it was possible to form an accurate or exact image stably and improve the printing speed very well.

In the embodiment, the deviation ΔT1 from the measured value 2.51T of the time T1 is 0, and the width WS of each non-ejection pulse is intermediate within the suitable range between 0.3T and 0.7T. It was therefore possible to form an exact image more stably and improve the printing speed better.

Effects and/or advantages of the ejector 600 will be explained.

After ejecting each ink droplet from each channel 613, the ejector 600 cancels the pressure wave vibration in the channel to stabilize the pressure in the channel. This simplifies the vibration which should be canceled after ejection of each droplet. Therefore, even if the ejection and the cancellation are slightly earlier or later than the respective optimum points, it is possible to cancel the vibration without difficulty. Consequently, even if the drive frequency fluctuates slightly, it is possible to make the quantity of each droplet substantially equal. As a result, it is possible to maintain good printing quality without raising part costs.

In order to show more specifically how the ejector 600 is advantageous, it and a comparative ink ejector were tested at drive frequencies of 7.5 kHz, 8.0 kHz and 8.5 kHz. The comparative ejector ejects ink for each dot by applying two ejection pulses and one non-ejection pulse after them. Table 1 shows the amount of ink ejected per dot by each ejector at each frequency.

TABLE 1

| | DRIVE FREEQUENCIES | | |
|---|---|---|---|
| | 7.5 kHz | 8.0 kHz | 8.5 kHz |
| EJECTOR EMBODYING THE INVENTION | 41 pl | 42 pl | 42 pl |
| COMPARATIVE EJECTOR | 37 pl | 43 pl | 50 pl |

As shown in Table 1, in comparison with the comparative ejector, the ejector 600 can eject a substantially constant amount of ink even if the drive frequency varies. This makes it possible to maintain good printing quality.

FIG. 7 shows the internal structure of an ink jet printer to which the ejector 600 embodying the invention is applied.

The printer includes four ink jet print heads 2 for printing a sheet of paper P by each ejecting onto it an ink of one of four colors (cyanogen, magenta, yellow and black). The ejector 600 is incorporated in each head 2. The heads 2 are mounted on a carriage 3. Removably mounted on the carriage 3 are ink cartridges 5 for each supplying one of the heads 2 with an ink. The carriage 3 is supported at its front and rear ends slidably on a pair of horizontally extending parallel guide bars 7 and 8, respectively. The carriage 3 can be reciprocated by the driving mechanism including a drive source, which is a carriage drive motor 9, a driving pulley 4, which can be driven by the motor 9, a driven pulley 6 and an endless belt 10, which runs between the pulleys. The carriage 3 is fixed to the belt 10, which can be turned to move it along the bars 7 and 8.

The print heads 2 are controlled by the timing production mechanism including an encoder 13 and an optical detector 14. The encoder 13 extends and has a number of indexes along the guide bar 8. The detector 14 can read the indexes. The detector 14 is fixed to the carriage 3 and connected to the I/O bus 216 in controllers 625 (FIG. 1) for the print heads 2. As the carriage 3 moves, the detector 14 outputs a signal, which causes the controllers 625 to produce timing for controlling the heads 2 (actuators). This provides accurate printing control even if the belt 10 slips slightly on the pulleys 4 and 6 while the carriage 3 is moving in the printing area.

The print heads 2 face a sheet feeder 11 including a roller 11*a*. Fixed to one end of the roller 11*a* is a gear 12, to which the driving force of a line feed motor (not shown) can be transmitted. The feeder 11 can feed a sheet of paper P to a position in front of the heads 2.

Located on one side of the sheet feeder 11 is a maintenance mechanism 15 for maintaining normal ejection of ink droplets from the print heads 2 and/or recovering them. The maintenance mechanism 15 includes a suction cap 24, four protective caps 16 and a wiper 26. While the heads 2 are used, air bubbles may be produced in them, and/or ink droplets may stick to the nozzles 618 (FIGS. 5A, 5B and 6), causing defective ejection of ink. The suction cap 24 can recover the heads 2 to their good ejecting condition by removing air bubbles and/or ink droplets. When the printer is not used, the protective caps 16 cap the nozzles to keep the inks from drying. Also when a print head 2 and/or an ink cartridge 5 are/is replaced, the suction cap 24 is driven to supply ink from the cartridge 5 smoothly to the nozzles of the associated head 2.

The carriage 3 can move between the printing area, where the print heads 2 face the sheet P in the feeder 11, and a maintenance area, where the heads 2 face the caps 24 and 16 of the maintenance mechanism 15.

The invention is not limited to the embodiment, but various modifications may be made without departing from the spirit of the invention.

The width WE of each ejection pulse is 1.0T where T is the one-way propagation time. Because the pressure wave vibration cycles at the period of 2T, the pulse width WE might instead be 3.0T, 5.0T or 0.7T, which is three or a larger odd number of times as long as T, for equivalent or similar ejection.

The interval T2 between the non-ejection pulse PS1 and the ejection pulse PE2 is 1.0T. It might only be required that the interval T2 be longer than the sum of the discharging time Tb (FIG. 2), when the non-ejection pulse PS1 falls, and the charging time Ta, when the ejection pulse PE2 rises. Specifically, the interval T2 might be 0.5T or longer.

In accordance with the print instruction for one dot, the ejector 600 carries out ejection of ink and cancellation of vibration twice alternately to eject two ink droplets. The ejector 600 may be adapted to carry out ink ejection and vibration cancellation three or more times alternately to eject three or more ink droplets for one dot.

A voltage lower than E volts or a negative voltage might be applied as each of the non-ejection pulses PS1 and PS2 to eject no ink when the pressure wave vibration is canceled. In the embodiment, the voltage of the ejection pulses PE1 and PE2 and the non-ejection pulses PS1 and PS2 is a constant value, and their rising and falling points ES1, EE1, SS1, SE1, ES2, EE2, SS2 and SE2 are timed to eject ink and cancel the pressure wave vibration. This enables the structure and the control of the ejector 600 to be simpler.

Second Embodiment

This embodiment explains a method of ejection control different from that described by the first embodiment. The ink ejectors for the two embodiments are substantially the same, but the signals for driving the actuators are different in waveform.

Figure 8:
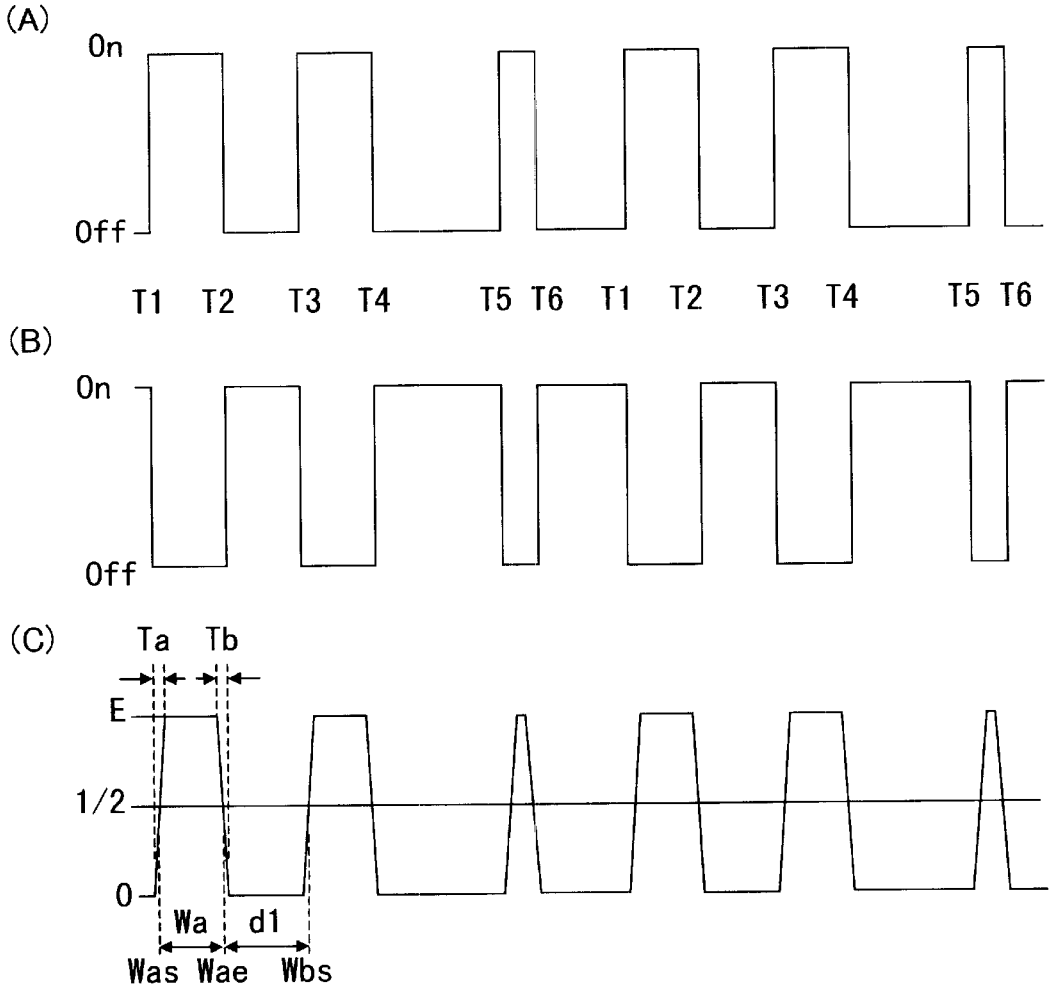
FIG. 8 is timing charts (A), (B) and (C) showing the operation of the charging and discharging circuits which form part of the controller in a second embodiment of the invention.

The signal input to the input terminal 187 of each charging circuit 182 shown in FIG. 1 is normally off, as shown in the timing chart of (A) in FIG. 8. For ejection of ink droplets, the input signal is rendered on at a point of time T1 and off at a point of time T2. Thereafter, the signal is alternately rendered on at points of time T (odd numbers) and off at points of time T (even numbers). When this signal is on (T1, T3 . . . , the signal input to the input terminal 188 of the associated discharging circuit 184 is rendered off, as shown in the timing chart of (B) of FIG. 8. When the signal input to the input terminal 187 of th[0085] chargin circuit 182 is off (T2, T4 . . . ), the signal input to the input terminal 188 of the discharging circuit 184 is rendered on, as also shown in (B) of FIG. 8.

The voltage applied to the terminal 191A of the associated capacitor 191 is normally held at 0 volt, as shown in (C) of FIG. 8. This voltage becomes E volts when a charging time Ta passes after the capacitor 191 starts charging at the point T1. The time Ta depends on the transistor TR102, the resistor R120 and the electric capacity of the actuator walls, which are shear mode type piezo-electric elements, corresponding to the capacitor 191. The voltage becomes 0 volt again when a discharging time Tb passes after the capacitor 191 starts discharging at the point T2. The time Tb depends on the transistor TR103, the resistor R120 and the actuator wall capacity.

Figure 9:
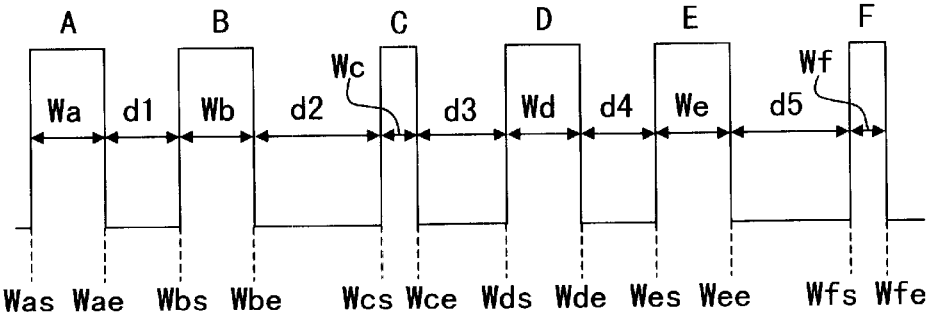
FIG. 9 is a timing chart illustrating an ink ejector drive waveform output from the controller in the second embodiment.

FIG. 9 shows an approximate drive waveform of voltage for application to the actuator walls of the ink ejector 600 for this embodiment. This drive waveform includes a plurality of ejection pulses A, B, D and E for ejection of ink from each channel 613. The waveform also includes two non-ejection pulses C and F for cancellation of the pressure wave vibration remaining in the channel 613. The non-ejection pulses C and F follow the ejection pulses B and E, respectively. In general terms, a number "N" of ejection pulses are output for one dot. The ejection pulses form groups (a group of pulses A and B and a group of pulses D and E) each consisting of a number "n" of serial ejection pulses. The number "n" is smaller than the number "N", but larger than one (N>n>1). Each group of ejection pulses is followed by one non-ejection pulse (C, F). In other words, the formation of one dot involves outputting the groups of the number "n" of serial ejection pulses and one non-ejection pulse.

FIG. 10 shows a table of the widths of the ejection and non-ejection pulses for this embodiment and the intervals between the pulses. In FIG. 10, the values for waveforms 1 and 2 are preferable ones, while the values for a waveform 3 represent possible ranges. The voltage of all the pulses is E volts.

The values for the waveform 1 in FIG. 10 will be used for the following description. When the ejection pulse A rises at a point of time Was, electric fields are generated in the appropriate actuator walls (603*e* and 603*f* in FIG. 6). The electric fields enlarge the volume of the associated channel 613, reducing the pressure in the channel, which includes the vicinity of the associated nozzle 618. Then, ink flows into the channel 613. In the meantime, the volume enlargement generates a pressure wave vibration, which develops a pressure. This pressure rises and reverses the pressure in the channel 613 into a positive pressure (higher than the centerline of vibration). The positive pressure reaches a peak near the point of time when the pressure wave one-way propagation time T passes after the point Was. The ejection pulse A falls at a point of time Wae. The width of this pulse A is a time Wa (1.0T). The pulse fall reduces the volume of the channel 613, generating a pressure, which is added to the foregoing positive pressure. The addition generates a high pressure in that portion of the channel 613 which is near to the nozzle 618. The high pressure ejects an ink droplet from the channel 613 through the nozzle 618.

Subsequently, the ejection pulse B rises at a point of time Wbs and falls at a point of time Wbe. The interval between the ejection pulses A and B is a time d1 (1.0T). The width of this pulse B is a time Wb (1.0T). The rising point Wbs is the point of time when the pressure in the channel 613 has fallen again. In synchronism with this, the channel 613 enlarges in volume. The falling point Wbe is the point of time when the pressure in the channel 613 has risen again. The volume of the channel 613 decreases at this point Wbe. This applies higher pressure to the ink in the channel 613, ejecting an ink droplet at high speed.

Subsequently, the non-ejection pulse C rises at a point of time Wcs and falls at a point of time Wce. The interval between the ejection pulse B and non-ejection pulse C is a time d2 (2.25T). The width of the non-ejection pulse C is a time Wc (0.5T). It is preferable that the non-ejection pulse C be generated across a point of time when the pressure in the channel 613 reverses from a positive to a negative. In this case, the non-ejection pulse C rises at the point Wcs before the pressure in the channel 613 reverses from the positive to the negative. This enlarges the channel 613, quickly lowering the positive pressure in it. Besides, the non-ejection pulse C falls at the point Wce, when the positive pressure has reversed to the negative. This raises the negative pressure quickly, thereby canceling the pressure wave vibration. The vibration cancellation prevents accidental ejection of ink, and makes it possible to transfer smoothly to the ejection in accordance with the ejection pulse D.

Subsequently, the ejection pulse D rises at a point of time Wds and falls at a point of time Wde. The interval between the non-ejection pulse C and ejection pulse D is a time d3 (0.5T). The width of this ejection pulse D is a time Wd (1.0T). Thereafter, the ejection pulse E and non-ejection pulse F rise and fall at timing similar to that when the ejection pulse B and non-ejection pulse C rise and fall. If it were necessary to eject another or more ink droplets for one dot, the ejection pulses D and E and the non-ejection pulse F would be output repeatedly at similar timing. It is not possible to completely cancel the pressure wave vibration even with the non-ejection pulse C. Therefore, the interval d3 (0.5T) between the non-ejection pulse C and ejection pulse D has been found experimentally in consideration of the residual pressure wave remaining in the channel 613 after the vibration cancellation with the non-ejection pulse C.

The values for the waveform 2 in FIG. 10 have been also found from an experiment. The interval d2 between the ejection pulse B and non-ejection pulse C of this waveform is 2.15T. The width Wc of this non-ejection pulse C is 0.5T. The interval d3 between the non-ejection pulse C and ejection pulse D of this waveform is 1.5T. The width Wd of this ejection pulse D is 0.5T. This width Wd is smaller than normal, but the experiment proves that the waveform 2 enables an expected amount of ink to be obtained more stably than the waveform 1, and also enables ink to be ejected stably onto the right spot without splashing or spraying. It is conceivable that this is related to the residual pressure wave vibration remaining after the cancellation with the non-ejection pulse C.

Through a variety of additional experiments, the inventor has found the following fact, as shown at the waveform 3 in FIG. 10:

the widths Wa, Wb, Wd and We of the ejection pulses A, B, D and E, respectively, can range between 0.3T and 1.3T; the interval d1 between the ejection pulses A and B and the interval d4 between the ejection pulses D and E can range between 0.7T and 1.3T; the widths Wc and Wf of the non-ejection pulses C and F, respectively, can range between 0.3T and 0.7T or between 1.3T and 1.8T;

the interval d2 between the ejection pulse B and non-ejection pulse C and the interval d5 between the ejection pulse E and non-ejection pulse F can range between 2.05T and 2.45T; and the interval d3 between the non-ejection pulse C and ejection pulse D can range between 0.30T and 2.00T, and preferably between 0.30T and 1.30T.

In particular, the inventor has diligently studied or examined methods of setting the width Wc of the non-ejection pulse C, the interval d2 preceding it and the interval d3 succeeding it. As a result, the inventor has discovered that it is possible to effectively cancel the pressure wave vibration by putting the non-ejection pulse C across a point of time when the pressure in the channel 613 reverses substantially from a positive to a negative for the second time (2.2T–2.8T and preferably about 2.5T) after the ejection with the ejection pulse B, and by setting the width Wc of the non-ejection pulse C substantially between 0.3T and 0.7T or between 1.3T and 1.8T. By setting the interval d3 between the non-ejection pulse C and the next ejection pulse D between 0.3T and 2.0T, preferably between 0.3T and 1.3T, it was possible to eject ink droplets stably onto the right spot without splashing them about.

In the case of the pulse width and intervals deviating from these ranges, one or more of the ejected ink droplets did not fly at suitable speed, stuck to a wrong spot or wrong spots on recording paper and/or splashed or sprayed. Some of the splashes or the spray stuck to the nozzle surface 617*a*, so that no ink could be ejected through the nozzle 618. For example, If the width Wc of the non-ejection pulse C were approximately 1.0T (Wc≈1.0T), the peak of the pressure wave vibration generated by the increase in volume (point Wcs) of the channel 613 and the rise in pressure due to the decrease in volume (point Wce) of the channel would be superimposed on each other, ejecting ink from the channel. If the pulse width Wc were approximately 2.0T (Wc≈2.0T), the pressure wave vibration due to the increase in volume and the pressure wave vibration due to the decrease in volume would cancel each other, resulting in a case similar to a case where the non-ejection pulse C is not generated. It is therefore conceivable that good cancellation of vibration can be carried out with the width Wc set between 0.3T and 0.7T, which are intermediate between 0 and 1.0T, or between 1.3T and 1.8T, which are intermediate between 1.0T and 2.0T.

Thus, the ink ejector for this embodiment ejects ink the number "N" of times in accordance with a print instruction for one dot. After ejecting ink each group of the number "n" of times, the ejector carries out vibration cancellation to stabilize the pressure in the channel. Consequently, the pressure wave vibration to be canceled each time is relatively simple. Therefore, even if the ejection and the cancellation deviate slightly from the optimum points of time, it is possible to cancel the pressure wave vibration without difficulty. Accordingly, even if the drive frequency fluctuates slightly, the amount of ink ejected the number "N" of times can be kept substantially constant. It is therefore possible to maintain good printing quality. There is no need to use an expensive motor and precisely machine parts, raising no costs.

An ink ejector according to this embodiment and a conventional ink ejector were tested at drive frequencies of 7.5 kHz, 8.0 kHz and 8.5 kHz. The conventional ejector ejects ink for one dot by applying four ejection pulses and one non-ejection pulse after them. Table 2 shows the actually measured amount in picoliters (pl) of ink ejected per dot by each ejector at each frequency. As shown in Table 2, the ejector according the embodiment can, in comparison with the conventional ejector (comparative ejector), eject a substantially constant amount of ink at all of the frequencies. This makes it possible to maintain good printing quality.

TABLE 2

| | DRIVE FREEQUENCIES | | |
|---|---|---|---|
| | 7.5 kHz | 8.0 kHz | 8.5 kHz |
| EJECTOR EMBODYING THE INVENTION | 82 pl | 84 pl | 84 pl |
| COMPARATIVE EJECTOR | 74 pl | 86 pl | 100 pl |

The invention is not limited to the embodiments described above, but various modifications may be made without departing from the spirit of the invention. For example, in the foregoing embodiment, the widths Wa, Wb, Wd and We of the ejection pulses are 1.0T where T is the one-way propagation time. Because the pressure wave vibration cycles at the period of 2T, the pulse widths could instead, for ejection of ink, be approximately 3.0T, 5.0T or 0.7T, which is three or a larger odd number of times as long as T.

In the foregoing embodiment, every two ejection pulses are followed by one non-ejection pulse. Instead, every three or more ejection pulses may be followed by a non-ejection pulse. The invention may also be applied to an apparatus having ink channels which can be changed in volume by actuators made of material which is not piezo-electric. In the above-embodiments, the use of piezo-electric material makes the ejector simpler in structure and more durable, and part costs lower. The invention may further be applied to a line printer, which includes an ink ejector fixed to its body.

What is claimed is:

1. An ink ejector comprising:

an ink jet head that ejects ink, the head having an ink channel formed therein, which is filled with ink, the head further having an ink nozzle formed therein and communicating with the channel, the head including an actuator provided therein that changes the volume of the channel; and a controller that controls the actuator to change the volume of the channel to carry out an ejection of an ink droplet from the channel through the nozzle a plurality of times in accordance with a print instruction for one dot;

the controller controlling the actuator to carry out substantial cancellation of pressure wave vibration in the channel after the ejection of each ink droplet is carried out.

2. The ink ejector defined in claim 1, wherein the ejection and the substantial cancellation involve applying an ejection voltage pulse of predetermined timing and width and a cancellation voltage pulse of predetermined timing and width, respectively, to the actuator.

3. The ink ejector defined in claim 2, wherein the ejection and the substantial cancellation are carried out by enlarging the ink channel in volume and then restoring the enlarged channel.

4. The ink ejector defined in claim 1, wherein the time required for the substantial cancellation ranges between 0.3T and 0.7T or between 1.3T and 1.8T where T is the one-way propagation time during which a pressure wave propagates one way in the ink channel.

5. The ink ejector defined in claim 2, wherein the width of the cancellation voltage pulse ranges between 0.3T and 0.7T or between 1.3T and 1.8T where T is the one-way propagation time during which a pressure wave propagates one way in the ink channel.

6. The ink ejector defined in claim 2, wherein the period between the trailing edge of the ejection voltage pulse and the middle point of the cancellation voltage pulse ranges between 2.35T and 2.65T where T is the one-way propagation time during which a pressure wave propagates one way in the ink channel.

7. The ink ejector defined in claim 6, wherein the period is about 2.5T.

8. The ink ejector defined in claim 2, wherein the middle point of the cancellation voltage pulse is set at the point when the pressure wave vibration passes the middle point of the amplitude of the vibration for the third time after the ejection voltage pulse is applied.

9. The ink ejector defined in claim 1, and further comprising:

a carriage for moving along a surface of a recording medium while holding the ink jet head thereon; and a detector for detecting the position of the carriage;

the controller for controlling the actuator on the basis of the detected carriage position.

10. The ink ejector defined in claim 9, wherein the detector includes:

an encoder extending in a directions in which the carriage moves, the encoder having indexes; and a sensor fitted on the carriage for reading the indexes.

11. The ink ejector defined in claim 2, wherein the width of the ejection voltage pulse is N·T wherein N is an odd number and T is the one-way propagation time during which a pressure wave propagates one way in the ink channel.

12. The ink ejector defined in claim 1, wherein both of the ejection and the substantial cancellation are carried out two or three times in accordance with a print instruction for one dot.

13. The ink ejector defined in claim 1, wherein the ink channel is formed between side walls made of piezoelectric material, the walls being the actuator.

14. The ink ejector defined in claim 1, wherein the controller includes a pulse control circuit.

15. The ink ejector defined in claim 14, wherein the pulse control circuit includes a data receiver, a memory, a processing unit and a pulse generator.

16. An ink jet printer comprising:

an ink jet head for ejecting ink, the head having an ink channel formed therein, which is filled with ink, the head further having an ink nozzle formed therein and communicating with the channel, the head including an actuator provided therein that changes the volume of the channel;

a carriage that moves along a surface of a recording medium, while holding the head thereon;

a detector that detects the position of the carriage; and a controller that controls the actuator on the basis of the detected carriage position to change the volume of the channel to carry out an ejection of an ink droplet from the channel through the nozzle a plurality of times in accordance with a print instruction for one dot;

the controller controlling the actuator to carry out substantial cancellation of pressure wave vibration in the channel after the ejection of each ink droplet is carried out.

17. The ink jet printer defined in claim 16, wherein the ejection and the substantial cancellation involve applying an ejection voltage pulse of predetermined timing and width and a cancellation voltage pulse of predetermined timing and width, respectively, to the actuator.

18. The ink jet printer defined in claim 17, wherein the ejection and the substantial cancellation are carried out by enlarging the ink channel once in volume and restoring the enlarged channel.

19. The ink jet printer defined in claim 17, wherein the width of the cancellation voltage pulse ranges between 0.3T and 0.7T or between 1.3T and 1.8T where T is the one-way propagation time when a pressure wave propagates one way in the ink channel.

20. The ink jet printer defined in claim 17, wherein the period between the trailing edge of the ejection voltage pulse and the middle point of the cancellation voltage pulse ranges between 2.35T and 2.65T where T is the one-way propagation time when a pressure wave propagates one way in the ink channel.

21. The ink jet printer defined in claim 16, wherein the detector includes:

an encoder extending in the directions in which the carriage can move, the encoder having indexes; and a sensor fitted on the carriage for reading the indexes.

22. An ink ejector comprising:

an ink jet head that ejects ink, the head having an ink channel and an ink nozzle formed therein, the channel communicating with the nozzle, the channel being filled with ink, the head including an actuator provided therein that changes the volume of the channel; and a controller that controls the actuator to change the volume of the channel to carry out "N" ejection operations, each of which ejects an ink droplet from the channel through the nozzle in accordance with a print instruction for one dot, wherein the "N" is an integer which is equal to or more than two;

the controller controlling the actuator to carry out at least twice a combination of "n" ejection operations and a cancellation operation which substantially cancels pressure wave vibration in the channel subsequent to the "n" ejection operations, wherein the "n" is an integer which is equal to or more than one, but smaller than the "N", and wherein the "n" ejection operations are a subset of a "N" ejection operation.

23. The ink ejector defined in claim 22, wherein the ejection operation and the cancellation operation involve applying pulsed drive voltage of predetermined timing and width to the actuator.

24. The ink ejector defined in claim 22, wherein the cancellation operation includes enlarging the ink channel in volume and restoring the enlarged channel, and a time required for the cancellation operation ranges between 0.3T and 0.7T or between 1.3T and 1.8T where T is one-way propagation time during which a pressure wave propagates one way in the ink channel.

25. The ink ejector defined in claim 24, wherein the pulsed drive voltage for the ejection operations has a first and second ejection pulses and the pulsed drive voltage for the cancellation operation has a cancellation pulse, and an interval between the second ejection pulse and the cancellation pulse ranges from 2.05T to 2.45T.

26. The ink ejector defined in claim 22, wherein the controller controls the actuator to carry out a first combination of the "n" ejection operations and the cancellation operation and a second combination of the "n" ejection operations and the cancellation operation, and an interval between the cancellation operation of the first combination and the ejection operations of the second combination ranges between 0.3T and 2.0T where T is one-way propagation time during which a pressure wave propagates one way in the ink channel.

27. The ink ejector defined in claim 22, and further comprising:

a carriage supporting the ink jet head thereon and being movable along a surface of a recording medium; and a detector for detecting the position of the carriage;

the controller controlling the actuator on the basis of the detected carriage position.

28. The ink ejector defined in claim 27, wherein the detector includes:

an encoder extending in directions in which the carriage moves, the encoder having indexes; and a sensor fitted on the carriage for reading the indexes.

29. The ink ejector defined in claim 22 for carrying out, twice in accordance with a print instruction for one dot, the combination of the "n" ejection operations and the cancellation operation.

30. An ink jet printer comprising:

an ink jet head that ejects ink, the head having an ink channel and an ink nozzle formed therein, the channel communicating with the nozzle, the channel being filled with ink, the head including an actuator provided therein that changes the volume of the channel;

a carriage supporting the head thereon and being movable along a surface of a recording medium;

a detector that detects the position of the carriage; and a controller that controls the actuator on the basis of the detected carriage position to change the volume of the channel to carry out "N" ejection operations, each of which ejects an ink droplet from the channel through the nozzle, in accordance with a print instruction for one dot, wherein the "N" is an integer which is equal to or more than two;

the controller controlling the actuator to carry out at least twice a combination of "n" ejection operations and a cancellation operation which substantially cancels pressure wave vibration in the channel subsequent to the "n" ejection operations, wherein the "n" is an integer which is equal to or more than one, but smaller than the "N", and wherein the "n" ejection operations are a subset of a "N" ejection operation.

31. The ink jet printer defined in claim 30, wherein the cancellation operation includes enlarging the ink channel in volume and restoring the enlarged channel, and involves applying a drive voltage pulse to the actuator, the width of the pulse ranging between 0.3T and 0.7T or between 1.3T and 1.8T where T is one-way propagation time during which a pressure wave propagates one way in the ink channel.

32. The ink jet printer defined in claim 31, wherein the ejection operations involve applying first and second drive voltage pulses to the actuator, and wherein the interval between the second drive voltage pulse of the ejection operations and the drive voltage pulse of the cancellation operation ranges between 2.05T and 2.45T.

33. The ink jet printer defined in claim 30, wherein the detector includes:

an encoder extending in directions in which the carriage moves, the encoder having indexes; and a sensor fitted on the carriage for reading the indexes.

34. The ink jet printer defined in claim 30, wherein the controller controls the actuator to carry out a first combination of the "n" ejection operations and the cancellation operation and a second combination of the "n" ejection operations and the cancellation operation, and an interval between the cancellation operation of the first combination and the ejection operations of the second combination ranges between 0.3T and 2.0T where T is one-way propagation time during which a pressure wave propagates one way in the ink channel.

* * * * *